United States Patent [19]

Tooley

[11] 4,042,062

[45] Aug. 16, 1977

[54] AIR PULSE NOISE DAMPER FOR A PNEUMATIC TOOL

[75] Inventor: Earl C. Tooley, Clayville, N.Y.

[73] Assignee: Chicago Pneumatic Tool Company, New York, N.Y.

[21] Appl. No.: 662,373

[22] Filed: Mar. 1, 1976

[51] Int. Cl.[2] ..... F01N 1/20

[52] U.S. Cl. ..... 181/36 A; 173/DIG. 2; 415/119; 417/312; 418/181

[58] Field of Search ..... 173/DIG. 2; 181/36 A, 181/36 D, 37, 39, 44–45; 415/119; 417/312; 418/181

[56] References Cited

U.S. PATENT DOCUMENTS

| | | | |
|---|---|---|---|
| 2,128,742 | 8/1938 | Fuehrer | 181/36 A |
| 2,643,731 | 6/1953 | Schmid | 181/36 A |
| 3,006,160 | 10/1961 | Heidorn | 417/312 X |
| 3,132,716 | 5/1964 | Williams | 181/37 X |
| 3,318,412 | 5/1967 | Bailey | 181/37 X |

*Primary Examiner*—Lawrence R. Franklin
*Attorney, Agent, or Firm*—Stephen J. Rudy

[57] ABSTRACT

A pneumatic tool having an exhaust air noise attenuating system in which air exhausting from a rotary air vane motor is caused to pass in order through an exhaust port, past a flexible leaf damper overlying the exhaust port into a wave modulating chamber containing an air diffusion screen, and finally through ports exiting to atmosphere. The damper is illustrated in a first form as applied to the motor of an impact wrench; and is illustrated in a second embodiment as applied to a grinding tool.

13 Claims, 6 Drawing Figures

Fig. 4
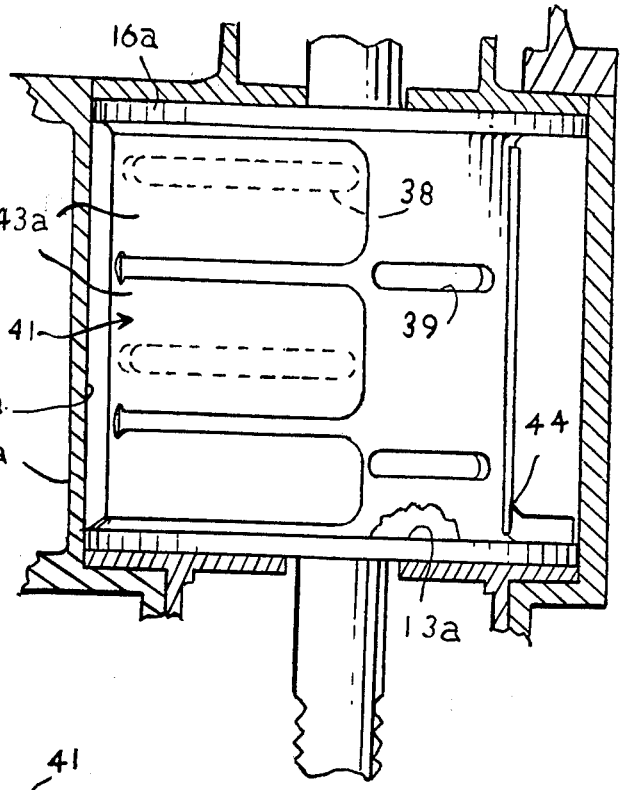
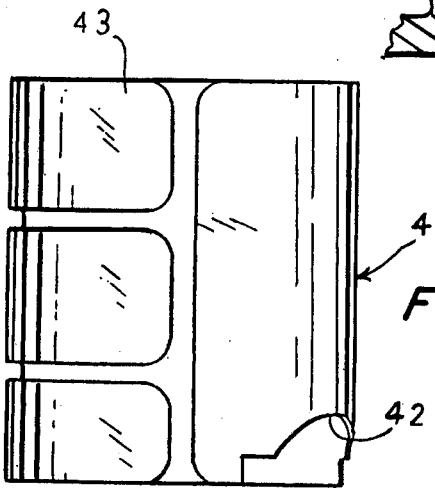
Fig. 6
Fig. 5
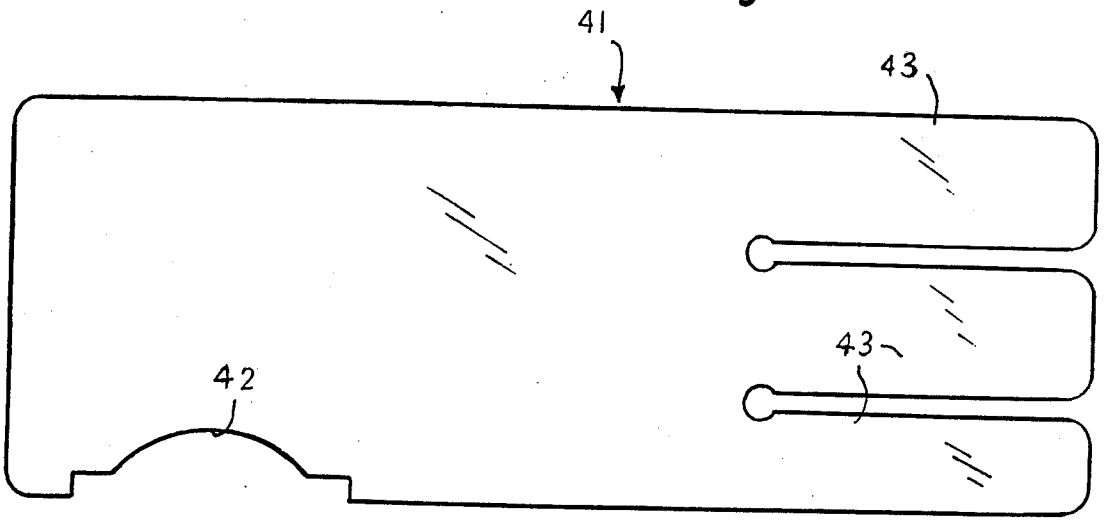

AIR PULSE NOISE DAMPER FOR A PNEUMATIC TOOL

BACKGROUND OF THE INVENTION

This invention is directed to improvements in means for attenuating the exhaust noise of pneumatically powered tools, such as impact wrenches, grinding tools, and the like.

While the invention may be subject to wide application, it is especially suited for use in pneumatically powered tools of the rotary air vane motor driven type.

In tools of this nature, the motor is driven at high speed by air having a constant pressure of 90 psi. The air spent in driving the vane motor is pulsed from the rotor chamber and exhausted to atmosphere. This pulsating air upon exhausting and expanding to atmosphere would, unless quieted, produce an objectionable noise of pulsating sounds varying in pitch and intensity.

The general objective of this invention is to improve the manner of passage of the exhausting air through the tool so that upon its exhausting to atmosphere the accompanying sound will be attenuated to an acceptable audible level.

In accordance with the invention there is provided a pneumatic tool including an air driven motor comprising a rotor liner defining a rotor chamber having an air driven multiple vane rotor operable therein and having at least one exhaust port through the periphery of the liner for exhaust of driving air from the rotor chamber; a housing for the tool encasing the motor; and a sound attenuating system through which the exhaust air passes to atmosphere, comprising: an annular chamber around the liner into which the exhaust port opens; a leaf spring flap damper disposed in the annular chamber in overlying relation to the exhaust port; and porting communicating the annular chamber to atmosphere; the damper being adapted to flex and oscillate relative to the exhaust port under pressure of air exhausting from the rotor chamber through the exhaust port into the annular chamber.

BRIEF DESCRIPTION OF THE DRAWING

In the accompanying drawing:

FIG. 4 is a sectional view of the motor assembly of a pneumatically powered vertical grinding tool;

FIG. 5 is a rolled out or development view of the damper element; and

FIG. 6 is a detail view of the damper element apart from the tool.

DESCRIPTION OF A PREFERRED EMBODIMENT OF THE INVENTION

Figure 1:
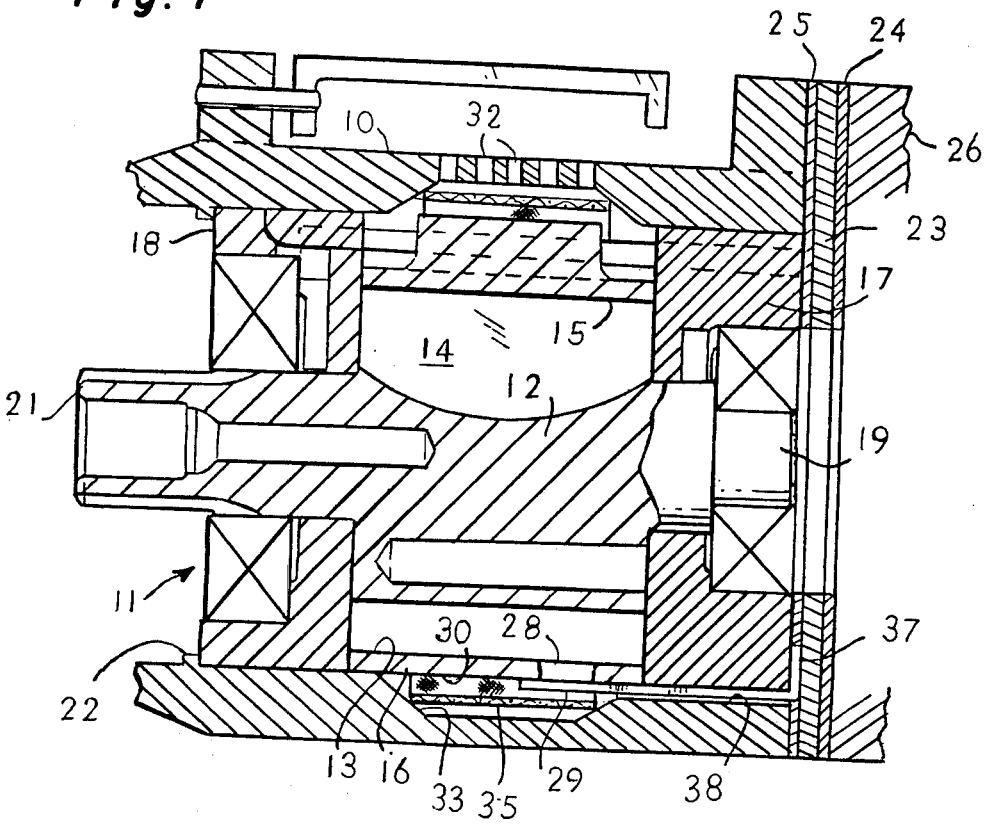
FIG. 1 is a sectional view of the motor assembly of a pneumatically powered impact wrench tool illustrating the invention, only so much of the tool as is believed needed to explain the invention being shown.
Figure 2:
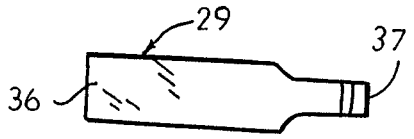
FIG. 2 is a detail view in plan of the flap damper element apart from the tool.
Figure 3:
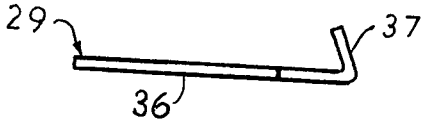
FIG. 3 is a side elevational view of FIG. 2.

Attention is directed to the several Figures of the accompanying drawing and now particularly to FIGS. 1–3, wherein the invention is illustrated as embodied in a pneumatically powered impact wrench. The tool has a general housing having a main section 10 in which a motor assembly 11 of a rotary air driven vane type is housed.

The motor assembly includes the usual rotor 12 which is supported eccentrically of a rotor chamber 13 for rotation therein. The rotor is provided with the usual radially slidable vanes 14 which, under pressure of live air admitted to the rotor chamber, sweep over the surrounding cylindrical wall 15 of the chamber. The rotor chamber is defined by an open-ended liner 16, the ends of which are closed by the usual pair of end plates 17, 18. The rotor has the usual axially projecting shaft ends 19, 21 supported in bearings fitted in the end plates.

The forward shaft end 21 is drivingly coupled to the usual torque impacting mechanism and associated output drive spindle, not shown. And, the output drive spindle carries the usual nut engaging socket, whereby a nut engaged by the socket may be set during operation of the tool. In the nut setting operation the tool operates initially to rapidly run the nut down to an initial degree of tightness, and then functions to transmit a series of torque impacting actions to set the nut to a final degree of tightness.

The forward end plate 18 of the motor assembly abuts an internal shoulder 22 of the housing; and the rear end plate 17 is exposed at a rear open end of the main housing section. A spacer plate 23 overlying the rear bearing plate, together with air sealing gaskets 24, 25 are sandwiched between the rear end wall of the main housing section and a backhead section 26 of the housing. The latter section is secured in place by a group of bolts, not shown.

A throttle valve, not shown, is provided in the backhead to control the admission of live air from an external source through the usual connecting passages to the rotor chamber to drive the rotor. Live air admitted to the rotor chamber acts upon the radially slidable vanes of the rotor to transmit torque through the rotor to the connected nut driving and setting mechanism. During rotation of the rotor its vanes sweep over the surrounding wall of the rotor chamber and force the spent driving air through a primary exhaust port 28.

The rotor is provided with a plurality of vanes 14; and is driven at high speed under a constant air pressure normally 90 psi. It can, accordingly, be seen that the spent air exhausts from the rotor chamber through the primary port 28 under high pressure and at a high frequency during free run-down or intial torquing of the work. During the successive impact actions that take place in final torquing of the work a momentary lull and pressure drop in the flow of exhaust air through port 28 arises because of the momentary lag or interval occurring between impacting actions of the tool. Under these conditions the sound pressure wave accompanying the high energy air exhausting through port 28 has a complex pattern of a pulsating nature varying in amplitude and frequency, and having not only a basic fundamental frequency but also various harmonic multiples thereof.

Were this complex high pressure sound wave pattern permitted to exhaust from port 28 directly to atmosphere, it would upon expanding outside of the tool produce an objectionable pulsating noise of varying intensity accompanied by objectionable audible sounds of irritating low and high pitch.

In a tool incorporating the present invention the nature and arrangement of the path over which the exhaust air travels through the tool from the rotor chamber to atmosphere causes much of the energy of the air to be dissipated; causes the exhaust air wave pattern to be substantially smoothed out or modulated in its pulsing nature; and serves to tune out much of the undesirable frequencies. The resulting sound produced by the finally exhausting air is substantially freed of the undesirable characteristics so as to be audibly acceptable.

Accordingly to the end of ameliorating the exhaust air sound characteristics, the spent air in exiting through the primary exhaust port 28 is caused to pass by a damper 29 in the form of a leaf spring or flexible flapper valve into a sound wave modulating chamber 30 before exhausting to atmosphere.

Chamber 10 is an annulus extending around the periphery of the liner. It is defined by an annular internal groove in the housing and the opposed periphery of the liner 16. The chamber is of shallow radial depth and relatively longer in its axial or longitudinal dimension. A group of final exhaust ports 32 communicate chamber 30 with atmosphere; and are located at a point substantially diametrically opposite to the entry point of the primary exhaust port 28.

Chamber 30 is an annulus extending around the peslope outwardly from opposite ends of the bottom wall of the chamber to meet the surface of the liner. Disposed in the chamber in surrounding relation to the liner is an exhaust air wave diffusion screen 35 of fine mesh, here about 60 mesh per inch. It is seated at its ends upon the sloping walls 33 so as to be preferably loosely disposed or slightly free of the opposed surface of the liner and the bottom wall of the chamber. This arrangement of the screen enables exhaust air passing through chamber 30 to flow in and out of the mesh holes of the screen as well as over the inner and outer areas of the screen without developing undesirable back pressure. It is understood that the screen may comprise several coils about the liner, provided undesirable back pressure does not result.

The damper 29 includes an elongated flat portion defining a flap 36; and it has a flange 37 angularly offset from a rear end of the flap for anchoring the damper in position. The flanged portion is located in an aperture in the forward gasket 25, and is securely sandwiched between opposed faces of the bearing plate 17 and the spacer plate 23. The flap 36 extends parallel to the axis of the liner or longitudinally from its anchorage over the periphery of the rear bearing plate and over a portion of the liner to overlie the primary port 28. An elongated rectangular groove 38 is formed in the inner surface of the housing rearwardly of chamber 30 to receive the flap. It serves to restrain the position of the flap against relative side slipping; and is slightly deeper than the thickness of the flap to permit sufficient flexing of the latter to allow easy exhaust of air from port 28 without developing undesirable back pressure.

The damper is formed of leaf spring steel. Its flange 37 is formed so as to have in its unassembled condition an angle to the flap of less than 90°, as best indicated in FIG. 3. When the flange is sandwiched in place, as in FIG. 1, an inherent bias is imparted to the flap, biasing it flat over the exhaust port 28 with a predetermined degree of pressure. It has been found by making the flange angle about 80° desirable biasing results are obtained.

In summary of the action that takes place in ameliorating the sound characteristics of air exhausting from the tool, the spent air is caused to be pulsed under high pressure and high frequency through port 28 from the rotor chamber. In exiting, its pulsating nature acts upon the damper flap 36 causing it to oscillate back and forth over port 28. As a consequence, much of the energy of the exhaust air is initially removed or damped as the air forces its way past the flap. Also, as the exiting air flows over the end and side portions of the flap into chamber 30, it divides into multiple streams of lesser volume with consequent energy loss.

The divided streams further divide and diffuse as they impinge against the nearby opposed bottom of chamber 30, and as they flow through the screen. Some of the divided and diffusing air streams flow clockwise, and other flow counterclockwise around the peripheral surface of the liner to the final exhaust ports 32. These air streams meet at the final exhaust ports and experience further energy loss. The manner of exhaust air flow through chamber 30 in effect tends to modulate or smooth out the pulsating nature of the exhaust air. And, upon escaping to atmosphere through the multiple final exhaust ports, the air streams are of a substantially nonpulsing nature, reduced in energy and in volume.

As earlier said, the sound accompanying the air finally exhausting from the tool is at an acceptable hearing level.

MODIFIED FORM OF THE DAMPER (FIGS. 4–6)

In the foregoing embodiment the damper 29 is illustrated in a form suitable for association with a single exhaust hole 28 opening through the liner of the rotor chamber.

In a tool where there are several exhaust ports opening through the liner of the rotor chamber, as in the case of a high speed pneumatic grinding tool, good results may require that the damper be associated with more than one of the exhaust ports. FIG. 4 illustrates in the motor assembly of a pneumatic vertical grinding tool a liner **16*a* defining a rotor chamber 13*a* having a group of exhaust ports 38, 39 opening through the periphery of the liner into an annular air wave modulating chamber 30*a* defined between the liner and the surrounding housing 10*a*.**

The liner, as in FIG. 4, discloses four exhaust ports extending circumferentially, and disposed in pairs; one pair 38 being shorter and spaced ahead of and relatively close to the other pair 39.

In this case the damper is shown in the form of a split band 41 having a group of flap fingers 43, here three formed at one end. The inner diameter of the band in its unassembled form (FIG. 6) is less than diameter of the periphery of the liner. The band is formed of spring material, such as spring tempered steel.

In assembling the band to the liner, its ends are spread apart sufficiently to allow the band, when next relaxed, to snap in place about the grooved surface of the liner. Before being relaxed, the band is adjusted or shifted circumferentially, if needed, until two of the flap fingers overlie the elongated exhaust ports, as in FIG. 4. The smaller diameter of the band relative to that of the liner results in sufficient spacing of the ends of the band to permit the other two smaller exhaust ports to be exposed or uncovered by the band.

A cutout 42 in a side edge of the band is designed to accommodate or fit about a protrusion in the surface area of the liner, as indicated at 44 in FIG. 4. Where a cutout in the band is provided, as here, it serves to facilitate assembly of the band to the liner. In this respect, the cutout is aligned to its proper place on the liner, and the band is then snapped in place.

The engagement of the cutout, together with the inherent inward spring bias of the band relative to the liner exerts an adequate force to retain the band from shifting its position under the stresses of tool vibration and exhausting air.

The two fingers 43a overlying the exhaust ports act in the manner of resilient flaps which flex and oscillate relative to the ports as the exhaust air is pulsed through the ports. They serve similarly to the flap in FIG. 1 to dampen the energy of the exhausting air. It has been found in some cases, as here, that appreciable results without developing undesirable back pressure can be obtained without the necessity of applying damper flaps to all of the exhaust ports.

It is apparent that the band form of the damper may also be used where only a single exhaust port is provided, whether the exhaust port be a round hole, or an opening that is laterally or circumferentially extended.

I claim:

1. A pneumatic tool including an air driven motor comprising a rotor liner defining a rotor chamber having an air driven multiple vane rotor operable therein and having at least one exhaust port through the periphery of the liner for exhaust of driving air from the rotor chamber; a housing for the tool encasing the motor; and a sound attenuating system through which the exhaust air passes to atmosphere, comprising: an annular chamber around the liner into which the exhaust port opens; a leaf spring flap damper disposed in the annular chamber in overlying relation to the exhaust port; and porting communicating the annular chamber to atmosphere; the damper being adapted to flex and oscillate relative to the exhaust port under pressure of air exhausting from the rotor chamber through the exhaust port into the annular chamber.

2. A pneumatic tool as in claim 1, wherein the damper extends parallel to the axis of the liner and is biased into overlying relation to the exhaust port.

3. A pneumatic tool as in claim 1, wherein the damper extends circumferentially with respect to the periphery of the liner and is biased into overlying relation to the exhaust port.

4. A pneumatic tool as in claim 1, wherein there are multiple exhaust ports opening through the periphery of the liner, and the damper includes multiple flexible flap fingers each biased into overlying relation with separate selected ones of the exhaust ports.

5. A pneumatic tool as in claim 1, wherein the damper is in the form of a split spring band disposed about the periphery of the liner in inwardly biased relation to the latter and having a circumferentially extending flexible flap finger biased into overlying relation to the exhaust port.

6. A pneumatic tool as in claim 1, wherein the annular chamber is an exhaust air wave modulating chamber, the liner has a plurality of exhaust ports opening from the rotor chamber through the periphery of the liner into the modulating chamber, and the damper is in the form of a split spring band disposed about the periphery of the liner in inwardly biased relation to the latter and having a plurality of circumferentially extending flap fingers each biased into overlying relation to a separate one of the exhaust ports.

7. A pneumatic tool including an air driven motor comprising a rotor liner defining a rotor chamber having an air driven multiple vane rotor operable therein and having a primary exhaust port through the liner for exhaust of driving air from the chamber; a housing for the tool encasing the motor; and a sound attenuating system through which the exhaust air passes to atmosphere comprising: an annular sound modulating chamber around the liner into which the exhaust port opens, a leaf spring flap damper having a fixed condition at one end and extending at its opposite free end into the modulating chamber in overlying relation to the exhaust port; and a final exhaust means communicating the modulating chamber through the housing to atmosphere; the damper being adapted to flex and oscillate relative to the primary exhaust port under pressure of air exhausting from the rotor chamber through the latter port.

8. A pneumatic tool as in claim 7, wherein the final exhaust means comprises a group of final exhaust ports through the housing located substantially diametrically to the primary exhaust port.

9. A pneumatic tool as in claim 8, wherein a screen is disposed in the modulating chamber.

10. A pneumatic tool as in claim 9, wherein the damper is inherently biased in overlying relation to the primary exhaust port.

11. A pneumatic tool as in claim 9, wherein the housing includes a main section housing the motor, and a backhead section secured against the rear of the main section; and the damper is formed of leaf spring material and is provided with a flange at its rear sandwiched between the main section and the backhead section.

12. A pneumatic tool as in claim 11, wherein the damper comprises a flap portion from the rear of which the flange is offset, and the flap portion is adapted to oscillate relative to the port in a groove formed in the main section of the housing.

13. A pneumatic tool as in claim 12, wherein the flange in an unassembled condition of the damper has an angle with the flap portion of less than 90°.

* * * * *